US011821608B2

(12) United States Patent
Cornelissen et al.

(10) Patent No.: US 11,821,608 B2
(45) Date of Patent: Nov. 21, 2023

(54) LIGHTING DEVICE HAVING LIGHT-TRANSMISSIVE COVER LAYER BETWEEN A LENS ARRAY AND A LIGHT SOURCE ARRAY

(71) Applicant: SIGNIFY HOLDING B.V., Eindhoven (NL)

(72) Inventors: Hugo Johan Cornelissen, Escharen (NL); Olexandr Valentynovych Vdovin, Maarheeze (NL); Ludovicus Johannes Lambertus Haenen, Sint Oedenrode (NL); Norbertus Antonius Maria Sweegers, Lierop (NL); Marc Andre De Samber, Lommel (BE)

(73) Assignee: SIGNIFY HOLDING B.V., Eindhoven (NL)

( * ) Notice: Subject to any disclaimer, the term of this patent is extended or adjusted under 35 U.S.C. 154(b) by 16 days.

(21) Appl. No.: 17/770,251

(22) PCT Filed: Oct. 23, 2020

(86) PCT No.: PCT/EP2020/079897

§ 371 (c)(1),
(2) Date: Apr. 19, 2022

(87) PCT Pub. No.: WO2021/083800

PCT Pub. Date: May 6, 2021

(65) Prior Publication Data

US 2022/0290844 A1 Sep. 15, 2022

(30) Foreign Application Priority Data

Oct. 28, 2019 (EP) ..... 19205615

(51) Int. Cl.
*F21V 11/14* (2006.01)
*F21V 5/00* (2018.01)
(Continued)

(52) U.S. Cl.
CPC ..... *F21V 11/14* (2013.01); *F21V 5/007* (2013.01); *F21V 5/08* (2013.01); *F21Y 2105/12* (2016.08);
(Continued)

(58) Field of Classification Search
CPC ..... F21V 11/14; F21V 5/004; F21V 5/007; F21V 5/08
See application file for complete search history.

(56) References Cited

U.S. PATENT DOCUMENTS 3,736,416 A * 5/1973 Goodwin ..... F21S 41/686 362/279
7,396,150 B2 * 7/2008 Ogawa ..... G02B 3/005 359/619
(Continued)

FOREIGN PATENT DOCUMENTS

EP 1696171 A1 8/2006
EP 2476943 A2 7/2012
(Continued)

*Primary Examiner* — Ismael Negron

(57) ABSTRACT

The lighting device includes a lens array having a plurality of lenses and a focal surface located at a focal distance from the lens array, a light source array having a plurality of light sources arranged to emit light towards the lens array with a light output distributed around a primary axis, and a cover layer having a light-transmissive surface portion delimiting light exit openings. The cover layer is positioned to substantially coincides with the focal surface. Each light source forms a combination with a closest lens, each combination having, in a plane perpendicular to the primary axis, a displacement length and a displacement direction, such that there are least two different displacement lengths and at least two different displacement directions.

12 Claims, 11 Drawing Sheets

(51) Int. Cl.

| | |
|---|---|
| ***F21V 5/08*** | (2006.01) |
| *F21Y 105/12* | (2016.01) |
| *F21Y 105/14* | (2016.01) |
| *F21Y 115/10* | (2016.01) |

(52) U.S. Cl.
CPC ..... *F21Y 2105/14* (2016.08); *F21Y 2115/10* (2016.08)

(56) References Cited

U.S. PATENT DOCUMENTS

| | | | | |
|---|---|---|---|---|
| 7,888,868 | B2 * | 2/2011 | Kuan | F21K 9/69 313/512 |
| 9,035,328 | B2 * | 5/2015 | Lowes | G09F 9/33 257/99 |
| 9,273,846 | B1 * | 3/2016 | Rossi | F21V 5/007 |
| 9,695,992 | B2 | 7/2017 | Schadt et al. | |
| 10,288,255 | B2 | 5/2019 | Tsai et al. | |
| 10,393,347 | B2 * | 8/2019 | Benitez | F21V 11/14 |
| 2006/0267037 | A1 * | 11/2006 | Lim | F21V 5/008 257/E33.073 |
| 2013/0170203 | A1 * | 7/2013 | Cheng | F21V 5/007 362/235 |
| 2019/0120460 | A1 | 4/2019 | Pelka | |

FOREIGN PATENT DOCUMENTS

| | | | |
|---|---|---|---|
| WO | 2007007271 | A2 | 1/2007 |
| WO | 2010150149 | A2 | 12/2010 |
| WO | 2013046081 | A1 | 4/2012 |
| WO | 2017144371 | A1 | 8/2017 |

* cited by examiner

LIGHTING DEVICE HAVING LIGHT-TRANSMISSIVE COVER LAYER BETWEEN A LENS ARRAY AND A LIGHT SOURCE ARRAY

CROSS-REFERENCE TO PRIOR APPLICATIONS

This application is the U.S. National Phase application under 35 U.S.C. § 371 of International Application No. PCT/EP2020/079897, filed on Oct. 23, 2020, which claims the benefit of European Patent Application No. 19205615.8, filed on Oct. 28, 2019. These applications are hereby incorporated by reference herein.

FIELD OF THE INVENTION

The present invention relates to a lighting device for providing a sparkling appearance.

BACKGROUND OF THE INVENTION

Many different types of luminaires are currently available in the marketplace. Examples of such luminaires are panel luminaires for use in or on a ceiling or a wall. Other examples are suspended luminaires. Luminaires are typically designed to have a spatially uniform luminance appearance. In other words, when looking at a luminaire, an area of uniform brightness is typically seen.

In general, it is difficult for manufacturers of luminaires to distinguish themselves from the competition. For this purpose, there is a need for luminaires that have a more interesting or lively appearance.

The aforementioned need can for example be fulfilled by a customizable lighting system that consists of light-emitting architectural panels. Whereas such a lighting system is very versatile and high-end, there still remains a need for a simpler way to create interesting (dynamic) light effects in a luminaire.

US-2019/120460 discloses a lamp that includes a plurality of light sources arranged in a planar array, each light source having a light-emitting diode (LED) and an optical element. The optical element includes a substantially transparent first portion having a first refractive index, the first portion being configured to receive light from the LED. The optical element further includes a substantially transparent second portion having a second refractive index greater than the first refractive index, the second portion having an emission surface with a two-lobed shape.

SUMMARY OF THE INVENTION

It is an object of the invention to provide a lighting device that is capable of creating an interesting (dynamic) light effect while the lighting device itself has a relatively simple construction.

According to an aspect of the invention, the object is achieved by means of a lighting device comprising (i) a lens array having a plurality of lenses and a focal surface located at a focal distance from the lens array, (ii) a light engine with one or more light-emitting elements and a light exit window, and (iii) a cover layer covering the light exit window. The cover layer has a surface portion that delimits a plurality of light exit areas, each light exit area having a higher transmittance than the surface portion. The light exit areas constitute a light source array having a plurality of light sources, each light source being arranged to emit light towards the lens array with a light output distributed around a primary axis, and the light sources together defining a light-emitting surface of the light source array. The light-emitting surface of the light source array substantially coincides with the focal surface of the lens array. In a projection plane perpendicular to the primary axis, each light source forms a combination with a closest lens. Each such combination of a light source and its associated closest lens has a displacement distance with a displacement length and a displacement direction. Consequently, the lighting device has a plurality of displacement lengths and a plurality of displacement directions.

The plurality of displacement lengths consists of n displacement lengths and the plurality of displacement directions consists of n displacement directions, wherein the number n is equal to 2 or more.

The n displacement lengths are distributed over $m_1$ subsets of displacement lengths, wherein each of the $m_1$ subsets consists of one or more identical displacement lengths. The n displacement directions are distributed over $m_2$ subsets of displacement directions, wherein each of the $m_2$ subsets consists of one or more identical displacement directions. Each of the numbers $m_1$ and $m_2$ is equal to 2 or more.

In other words, the plurality of displacement lengths comprises at least two different displacement lengths, and the plurality of displacement directions comprises at least two different displacement directions.

The number $m_1$ and/or the number $m_2$ may be at least 10% of the number n, such as at least 20%, at least 50%, at least 75% or at least 90%. For example, if the light source array of the lighting device has 1,000 light sources, the plurality of displacement lengths consists of 1,000 displacement lengths and the plurality of displacement directions consists of 1,000 displacement directions (n=1,000). The 1,000 displacement lengths may be distributed over at least 100 subsets of identical displacement lengths ($m_1 \geq 100$), such as at least 200, at least 500, at least 750 or at least 900 subsets. Simultaneously or alternatively, the 1,000 displacement directions may be distributed over at least 100 subsets of identical displacement directions ($m_2 \geq 100$), such as at least 200, at least 500, at least 750 or at least 900 subsets.

The above lighting device has a relatively simple construction and it is arranged to provide a sparkling light effect to an observer.

The plurality of displacement lengths may be distributed over a displacement length range having an upper displacement length limit, wherein the ratio of the upper displacement length limit and the focal distance is at least 0.18.

In the above lighting device, the light exit areas may be through openings and the surface portion of the cover layer may be light-reflective or light-transmissive, such as diffusely light-transmissive and/or colored.

The light engine may have a light mixing chamber with an internal surface arrangement, the internal surface arrangement having a back surface opposite to the light exit window and a side surface separating the back surface and the light exit window, wherein the one or more light-emitting elements are provided on at least one of the back surface and the side surface, and wherein the one or more light-emitting elements are arranged to emit light towards the light exit window, either directly or via reflection on the internal surface arrangement.

The light engine may have a light guide element with a light incoupling surface and a light outcoupling surface, wherein the one or more light-emitting elements are arranged to emit light into the light guide element via the light incoupling surface, wherein the light guide element comprises light extraction features to redirect light out of the light guide element via the light outcoupling surface, and wherein the light outcoupling surface of the light guide element constitutes the light exit window of the light engine.

The focal surface of the lens array and the light-emitting surface of the light source array may be planar surfaces oriented parallel to each other.

Each of the plurality of lenses and the plurality of light sources may be arranged on a regular grid or on an irregular grid.

The term "grid" should be interpreted to refer to a pattern of positions. Such a grid, or pattern of positions, can be regular or irregular. In a regular grid, the positions that constitute the pattern are repeated in a way that is predictable. In an irregular grid, the positions that constitute the pattern are repeated in a way that is not predictable. An irregular grid is a pattern of positions that is not defined by any symmetry, shape, formal arrangement, or continuity.

The plurality of lenses may be distributed on a regular lens grid with a shortest lens pitch. Each displacement length may be equal to or smaller than half the shortest lens pitch. The regular lens grid may be one of a rectangular grid, a square grid or a hexagonal grid. The plurality of light sources may also be distributed on a regular light source grid, wherein the regular lens grid and the regular light source grid are mutually rotated with respect to each other.

The plurality of lenses may be distributed on an irregular lens grid while the plurality of light sources is distributed on a regular light source grid.

The plurality of lenses may be distributed on an irregular lens grid while the plurality of light sources is distributed on an irregular light source grid.

BRIEF DESCRIPTION OF THE DRAWINGS

Lighting devices according to the invention will now be described, by way of example only, with reference to the accompanying schematic drawings in which corresponding reference symbols indicate corresponding parts, and in which.

The schematic drawings are not necessarily to scale.

DETAILED DESCRIPTION OF THE EMBODIMENTS

Figure 1:
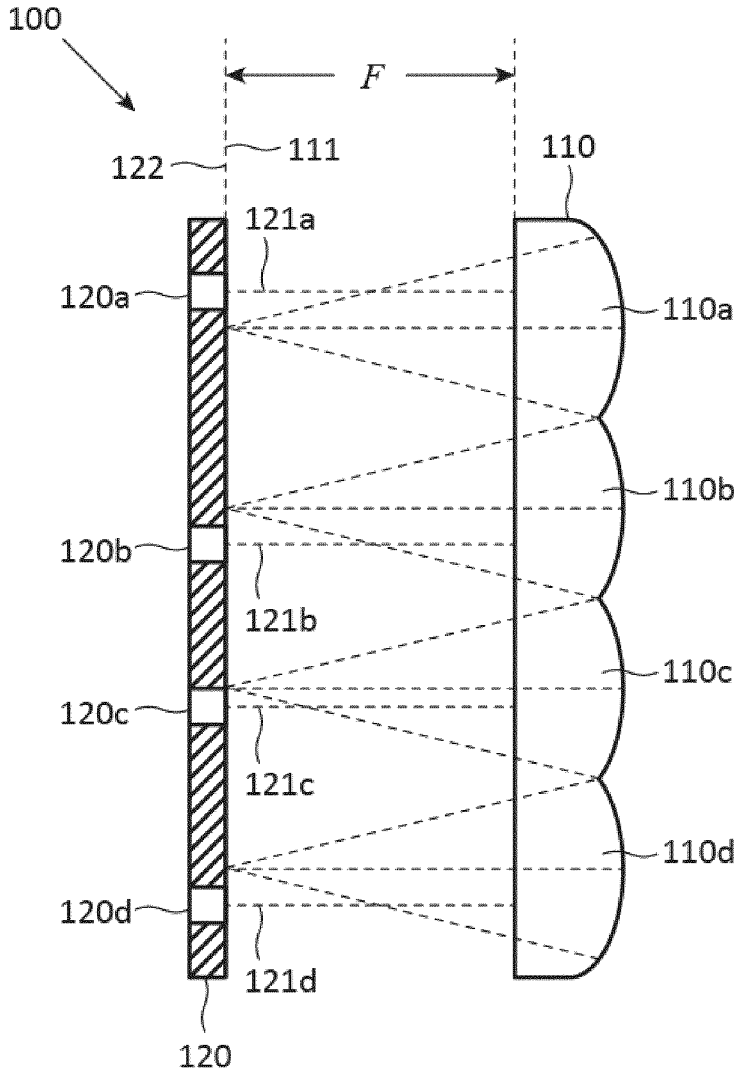
FIG. 1 shows a cross sectional view of a lighting device.

FIG. 1 shows a cross sectional view of a lighting device 100. The lighting device 100 has a lens array 110 with a plurality of lenses 110*a-d*. The lens array 110 is a microlens array wherein the lenses 110*a-d* are spherical lenses. The lens array 110 further has a focal surface 111, being the surface that contains the focal points of the lenses 110*a-d*.

The lighting device 100 also has a light source array 120 with a plurality of light sources 120*a-d*. Each light source 120*a-d* is arranged to emit light towards the lens array 110 with a light output distributed around a primary axis 121*a-d*.

Together, the light sources 120*a-d* define a light-emitting surface 122 of the light source array 120. The light-emitting surface 122 of the light source array 120 substantially coincides with the focal surface 111 of the lens array 110.

In the lighting device 100, the focal surface 111 of the lens array 110 and the light-emitting surface 122 of the light source array 120 are planar surfaces oriented parallel to each other. The primary axes 121*a-d* are oriented parallel to each other, and perpendicular to each of the focal surface 111 of the lens array 110 and the light-emitting surface 122 of the light source array 120.

Alternatively, the focal surface of the lens array and the light-emitting surface of the light source array may be curved surfaces, or any other type of surface, as long as the light-emitting surface of the light source array substantially coincides with the focal surface of the lens array. For example, the lens array may be shaped in the form of a spherical dome or a spheroidal dome.

FIG. 2 again shows the lighting device 100 of FIG. 1, but now when viewed in a direction from the lens array 110 towards the light source array 120.

Figure 2:
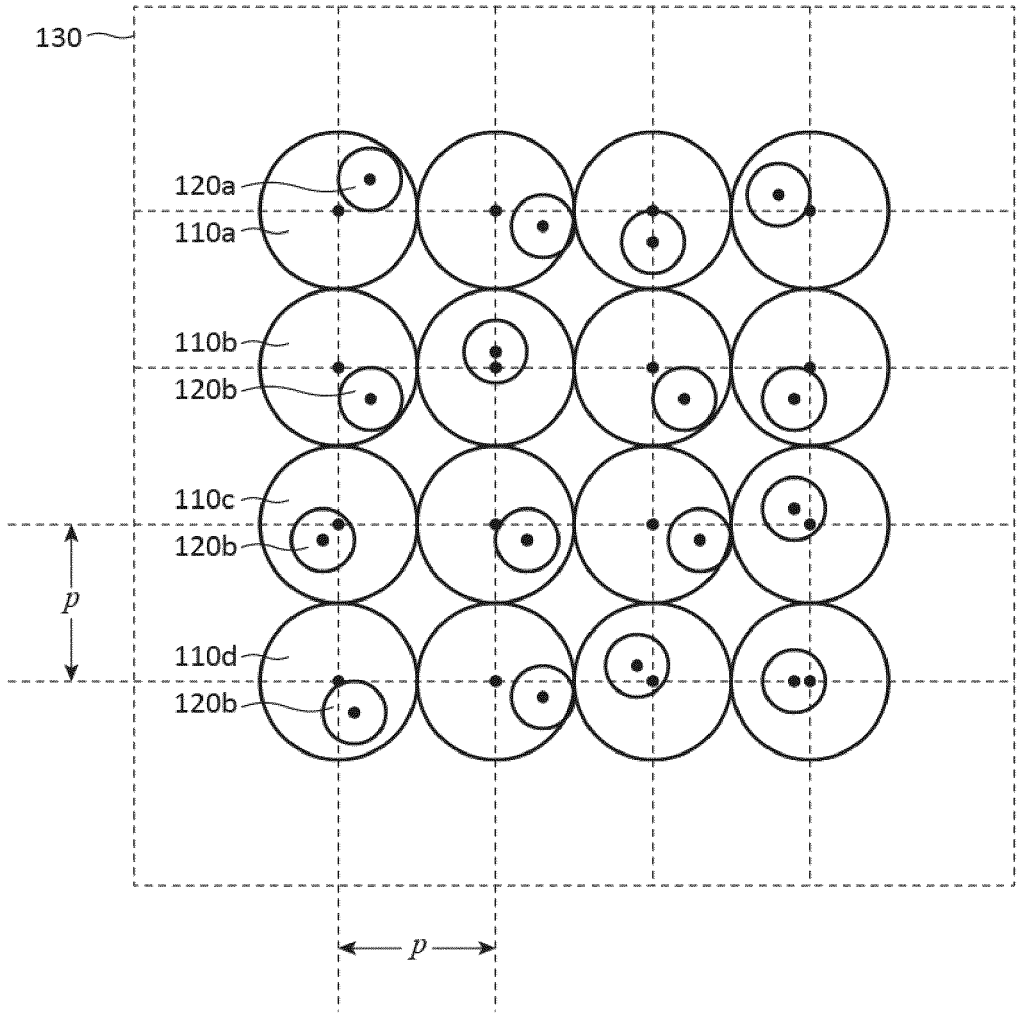
FIG. 2 shows the lighting device of FIG. 1 when viewed in a direction from the lens array towards the light source array.

FIG. 2 shows a projection plane 130. The projection plane 130 is oriented perpendicular to the primary axes 121*a-d*. Projections of the lenses (larger circles) and of the light sources (smaller circles) are shown in the projection plane 130. The projected centers of the lenses and the light sources are shown as black dots.

As can be seen in FIG. 2, the lighting device 100 has sixteen lenses that are distributed on a square lens grid with a lens pitch p. The lighting device 100 also has sixteen light sources that are distributed in an irregular light source grid.

Alternatively, the lighting device may have any number of lenses and any number of light sources, wherein the number of lenses may be equal to or different from the number of light sources. Moreover, each of the plurality of light sources and the plurality of lenses may be arranged on a regular or irregular grid. Examples of suitable regular grids are a rectangular grid such as a square grid, and a hexagonal grid. An example of a suitable irregular grid is a randomized grid.

In the projection plane 130, each light source forms a combination with a closest lens. To find a combination of a light source and its associated closest lens one has to look at the projected centers of the light sources and the lenses in the projection plane 130. Each projected center of a light source is separated from the projected centers of the lenses by a certain distance (which may be zero). The lens whose projected center has the shortest separation distance to the projected center of the light source in the projection plane 130 is the closest lens with respect to that light source. For example, light source 120*a* forms a combination with closest lens 110*a*, light source 120*b* forms a combination with closest lens 110*b*, light source 120*c* forms a combination with closest lens 110*c*, and light source 120*d* forms a combination with closest lens 110*d*.

FIG. 3 again shows the projection plane 130 of FIG. 2. For the sake of clarity, the projections of the light sources and lenses have been omitted, only the projected centers of the light sources and the lenses are still shown. In the projection plane 130, each combination of a light source and its associated closest lens has a displacement distance 131, being the distance between the projected centers of the light source and of its associated closest lens.

Each displacement distance 131 is characterized by a displacement length L and a displacement direction d. The displacement direction d represents the orientation of the displacement distance 131 in the projection plane 130, which in FIG. 3 is indicated with a dashed straight line.

All displacement distances 131 together represent a plurality of displacement lengths L and a plurality of displacement directions d.

In the lighting device 100, each displacement length L is equal to or smaller than half the lens pitch p, but this does not necessarily have to be the case. When the lens array has different pitches in two mutually orthogonal directions, each displacement length L may be equal to or smaller than half the shortest lens pitch, but again, this does not necessarily have to be the case.

Figure 3:
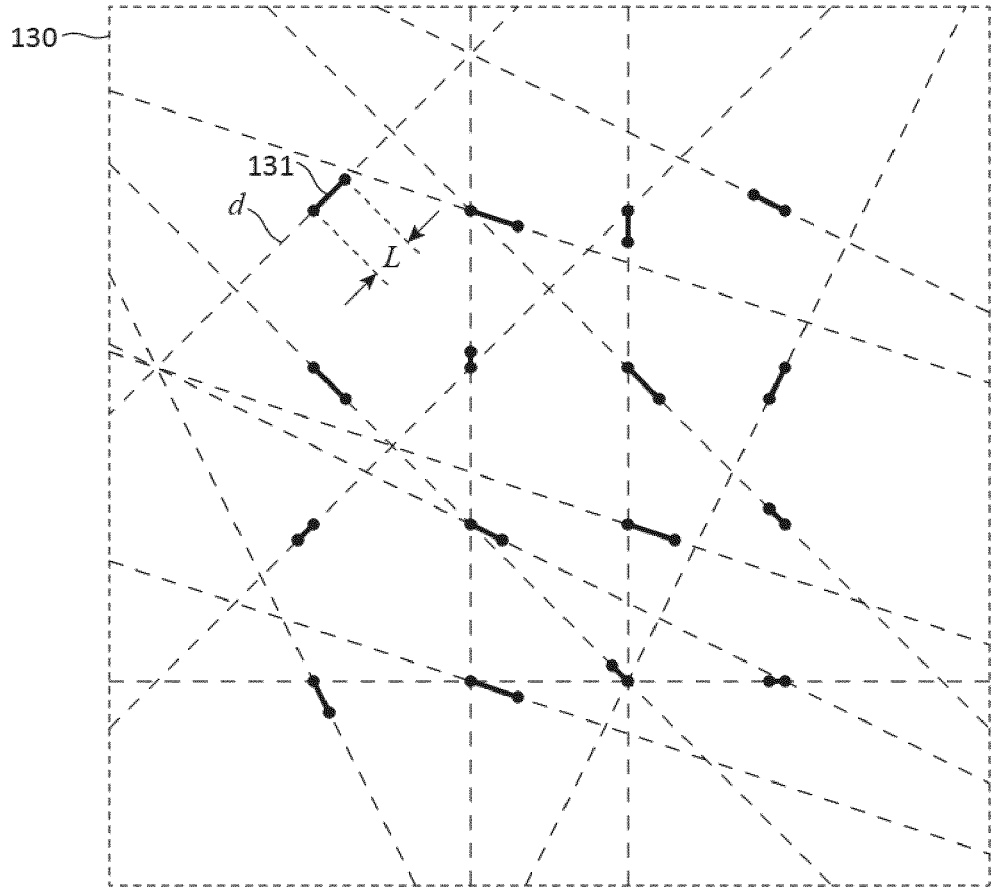
FIG. 3 shows the lighting device of FIG. 1 when viewed in a direction from the lens array towards the light source array.
Figure 4:
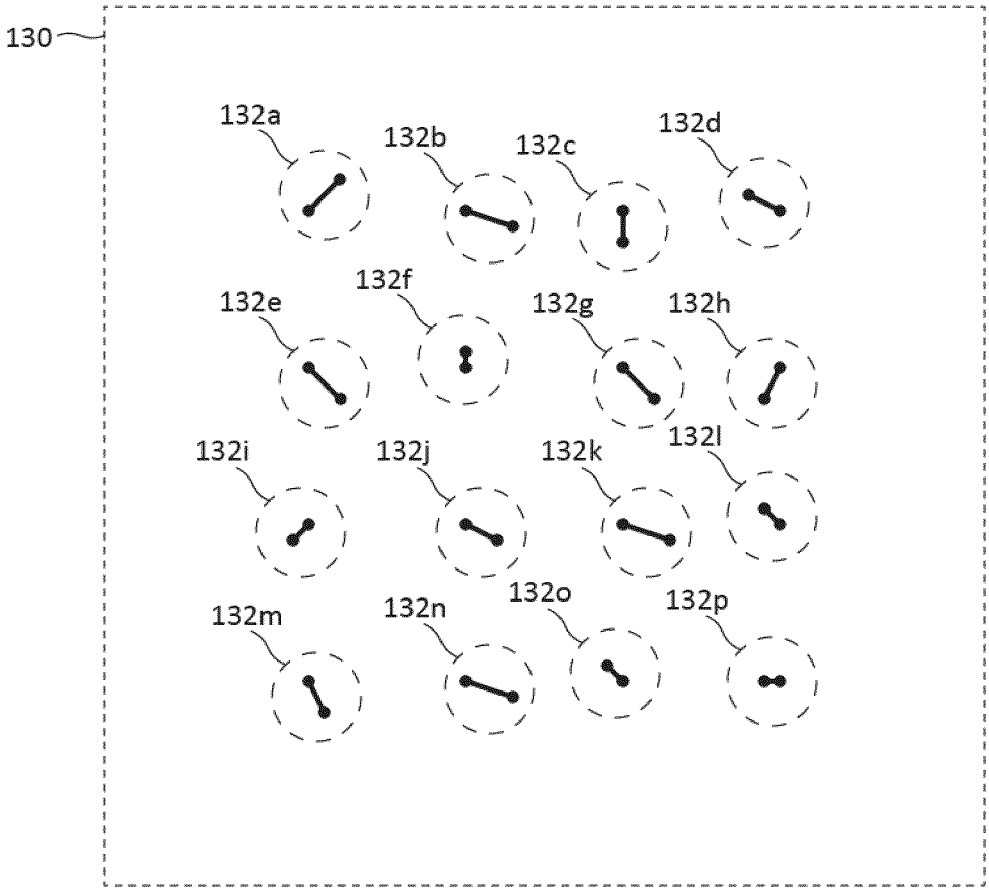
FIG. 4 shows the lighting device of FIG. 1 when viewed in a direction from the lens array towards the light source array.

FIG. 4 again shows the projection plane 130 of FIGS. 2 and 3. For the sake of clarity, the dashed lines representing the displacement directions d have been omitted, only the projected centers of the light sources and the lenses and the displacement distances are still shown. FIG. 4 shows the combinations 132*a-p* of light sources and associated closest lenses, each combination 132*a-p* having a displacement distance that is characterized by a displacement length L and a displacement direction d.

The lighting device 100 illustrated in FIGS. 1 to 4 has sixteen combinations of a light source and an associated closest lens, each combination having a displacement length L. In an alternative lighting device, there may be more or less than sixteen combinations of a light source and an associated closest lens, such as at least 50 combinations, or at least 100 combinations, or at least 500 combinations, or at least 1,000 combinations.

Two or more combinations of a light source and an associated closest lens may have the same displacement length L and the same displacement direction d, as long as within all combinations of a light source and an associated closest lens there are at least two different displacement lengths L and at least two different displacement directions d.

In FIG. 4, combinations 132*b*, 132*k* and 132*n* have the same displacement length L and the same displacement direction d. The same holds true for combinations 132*d* and 132*j*, and for combinations 132*l* and 132*o*, respectively.

Combinations 132*a* and 132*g* have the same displacement length L but opposite displacement directions d. The same holds true for combinations 132*h* and 132*m*, and for combinations 132*i* and 132*o*, respectively.

Combinations 132*f* and 132*p* have the same displacement length L but mutually perpendicular displacement directions d.

Combinations 132*c* and 132*f* have the same displacement direction d but different displacement lengths L. The same holds true for combinations 132*e*, 132*g*, 1321 and 132*o*.

All combinations 132*a-p* together represent a plurality of displacement lengths L and a plurality of displacement directions d. The plurality of displacement lengths L contains several different displacement lengths L, and the plurality of displacement directions d contains several different displacement directions d.

The displacement lengths L are distributed over a displacement length range. The displacement length range has a lower displacement length limit $L_{min}$ and an upper displacement length limit $L_{max}$.

In the lighting device 100 illustrated in FIGS. 1 to 4, the lower displacement length limit $L_{min}$ has a non-zero value. In an alternative lighting device, the lower displacement length limit $L_{min}$ may be zero.

In operation, the lighting device 100 of FIGS. 1 to 4 provides a light output that is perceived by an observer as a sparkling light effect.

Figure 5:
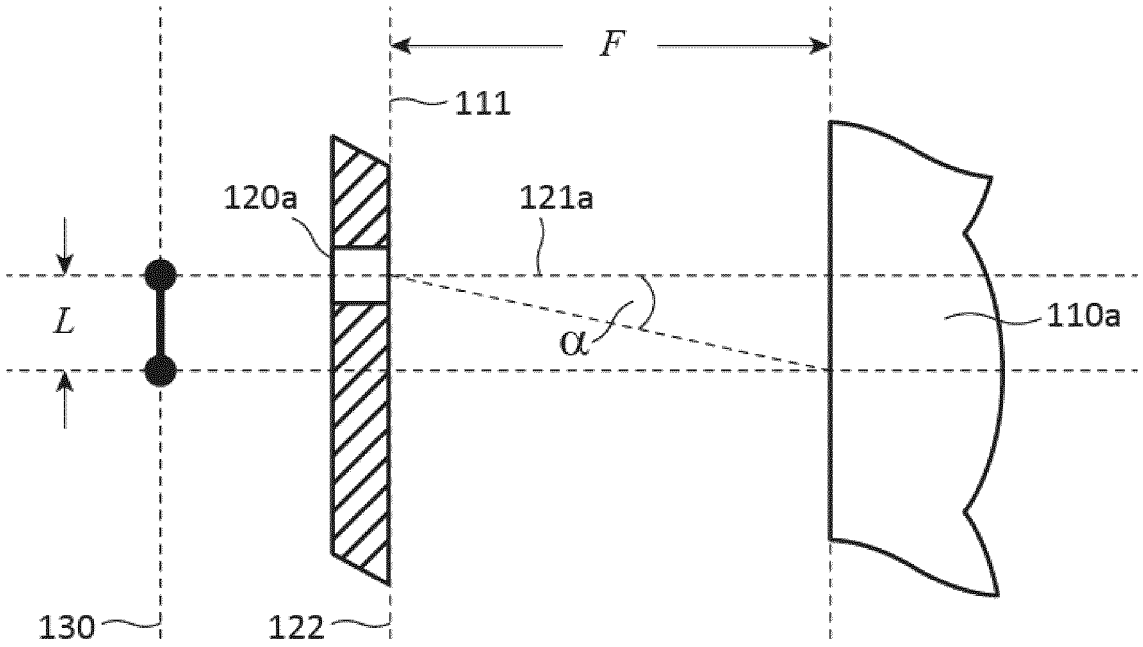
FIG. 5 shows an enlarged part of the cross-sectional view of FIG. 1, focusing on a combination of a light source and its associated closest lens.

FIG. 5 shows an enlarged part of the cross-sectional view of FIG. 1, focusing on the combination of light source 120*a* and its associated closest lens 110*a*. Also shown in FIG. 5 is the projection plane 130 and the displacement length L of the combination of light source 120*a* and lens 110*a*. The displacement length L has a non-zero value because the centers of the light source 120*a* and of the lens 110*a* are offset relative to each other with an offset angle α. The offset angle α is the angle between the primary axis 121*a* and the line that connects the center of the light source 120*a* with the center of the closest lens 110*a*. The tangent of the offset angle α is equal to the ratio of the displacement length L and the focal distance F.

For each combination of a light source and its associated closest lens, the imaginary line segment that connects the center of the light source to the center of the lens lies on the surface of an imaginary cone with a cone aperture that is equal to twice the offset angle α, a cone height that is equal to the focal distance F, and a cone base radius that is equal to the displacement length L.

The inventors found that, to optimize the sparkling light effect, the cone apertures should be at least 20 degrees, such as at least 40 degrees, or at least 90 degrees. For a cone aperture of 20 degrees, the ratio between the cone base radius and the cone height, which corresponds to the ratio between the displacement length L and the focal distance F, is approximately 0.18. For a cone aperture of 40 degrees, the ratio between the cone base radius and the cone height, which corresponds to the ratio between the displacement length L and the focal distance F, is approximately 0.36. For a cone aperture of 90 degrees, the ratio between the cone base radius and the cone height, which corresponds to the ratio between the displacement length L and the focal distance F, is equal to 1.

Figure 6:
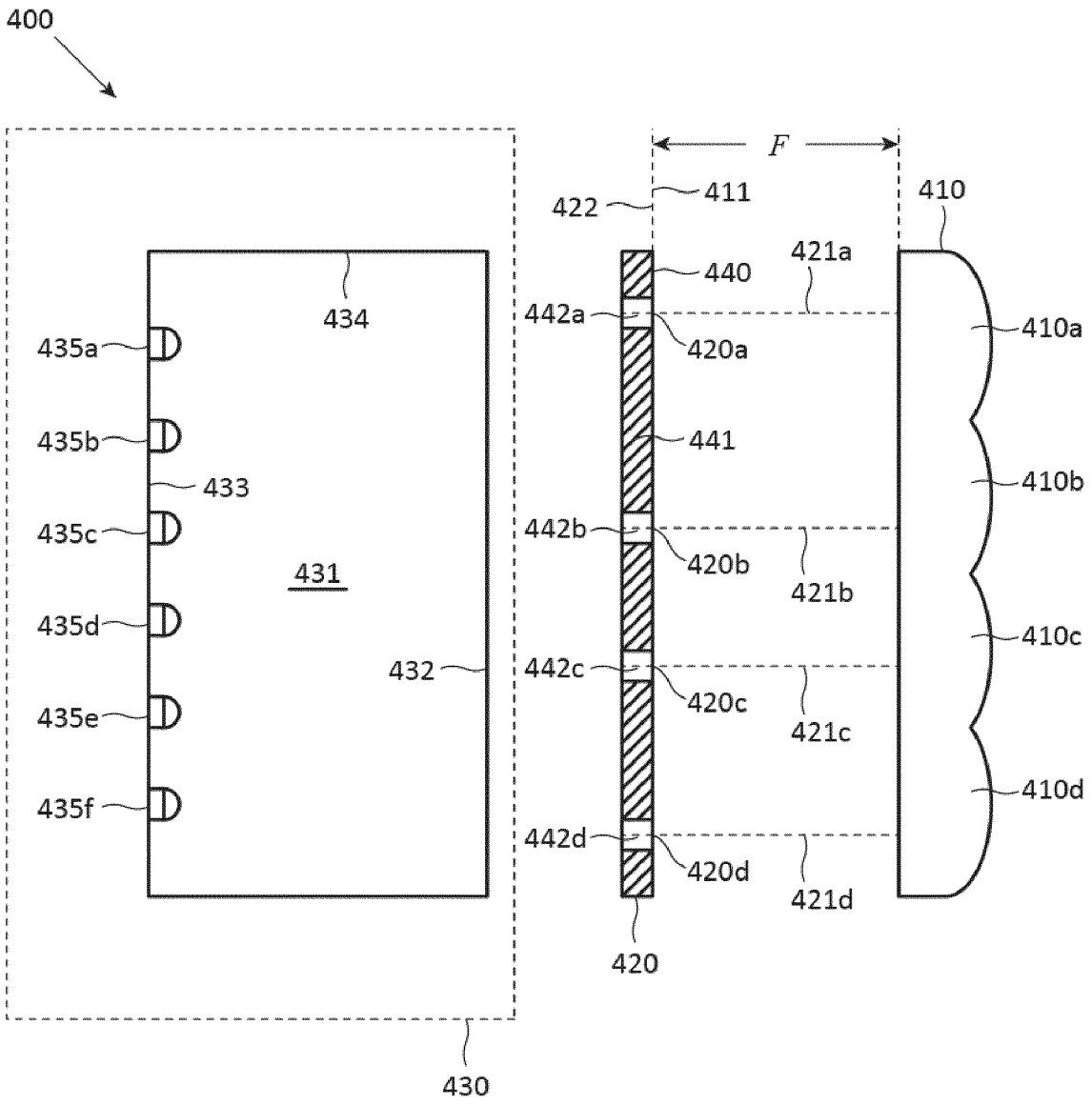
FIG. 6 shows a cross sectional view of a lighting device.

FIG. 6 shows a cross sectional view of a lighting device 400. The lighting device 400 has a lens array 410 with a plurality of lenses 410*a-d*. The lens array 410 further has a focal surface 411, being the surface that contains the focal points of the lenses 410*a-d*.

The lighting device 400 also has a light engine 430. The light engine 430 has a light mixing chamber 431 with an internal surface arrangement. The internal surface arrangement has a back surface 433 opposite to a light exit window 432 and a side surface 434 separating the back surface 433 and the light exit window 432. A plurality of light-emitting elements 435*a-f* is provided on the back surface 433. The light-emitting elements 435*a-f* are light-emitting diodes. Alternatively, the light-emitting elements may be other types of light-emitting elements, such as laser diodes.

The light-emitting elements 435*a-e* are arranged to directly emit light towards the light exit window 432.

In the lighting device 400, a cover layer 440 covers the light exit window 432 of the light engine 430. The cover layer 440 has a surface portion 441 that delimits a plurality of light exit areas 442*a-d*. The surface portion 441 is light-reflective, and each light exit area 442*a-d* is a through opening in the cover layer 440. Because the surface portion 441 is light-reflective, light that is emitted through the light exit window 432 of the light engine 430 but which is not incident on a light exit area 442*a-d* of the cover layer 440 is reflected back into the mixing chamber 431 of the light engine 430 by the surface portion 441 to thereby increase the overall efficiency, and to provide a sparkling light effect of increased contrast.

Alternatively, the surface portion may be light-transmissive and the light exit areas do not have to be through openings, as long as the light exit areas have a higher transmittance than the surface portion. The light exit areas may be transparent areas, not necessarily through openings, delimited by a diffusely light-transmissive and/or colored surface portion. For example, the cover layer may be a foil with through holes in a blue diffusely light-transmissive surface portion, so that the lighting device is arranged to provide a sparkling light effect on a blue diffuse background illumination. The cover layer may also contain imagery, such as a blue sky with clouds, or a cherry blossom tree, or a night sky scene, so that the sparkling light effect adds a dynamic effect to a static background image.

In the lighting device 400, the light exit areas 442*a-d* of the cover layer 440 constitute a light source array 420 with a plurality of light sources 420*a-d*. The light sources 420*a-d* are arranged to emit light towards the lens array 410 with a light output distributed around a primary axis 421*a-d*. The light sources 420*a-d* together define a light-emitting surface 422 of the light source array 420.

Figure 7:
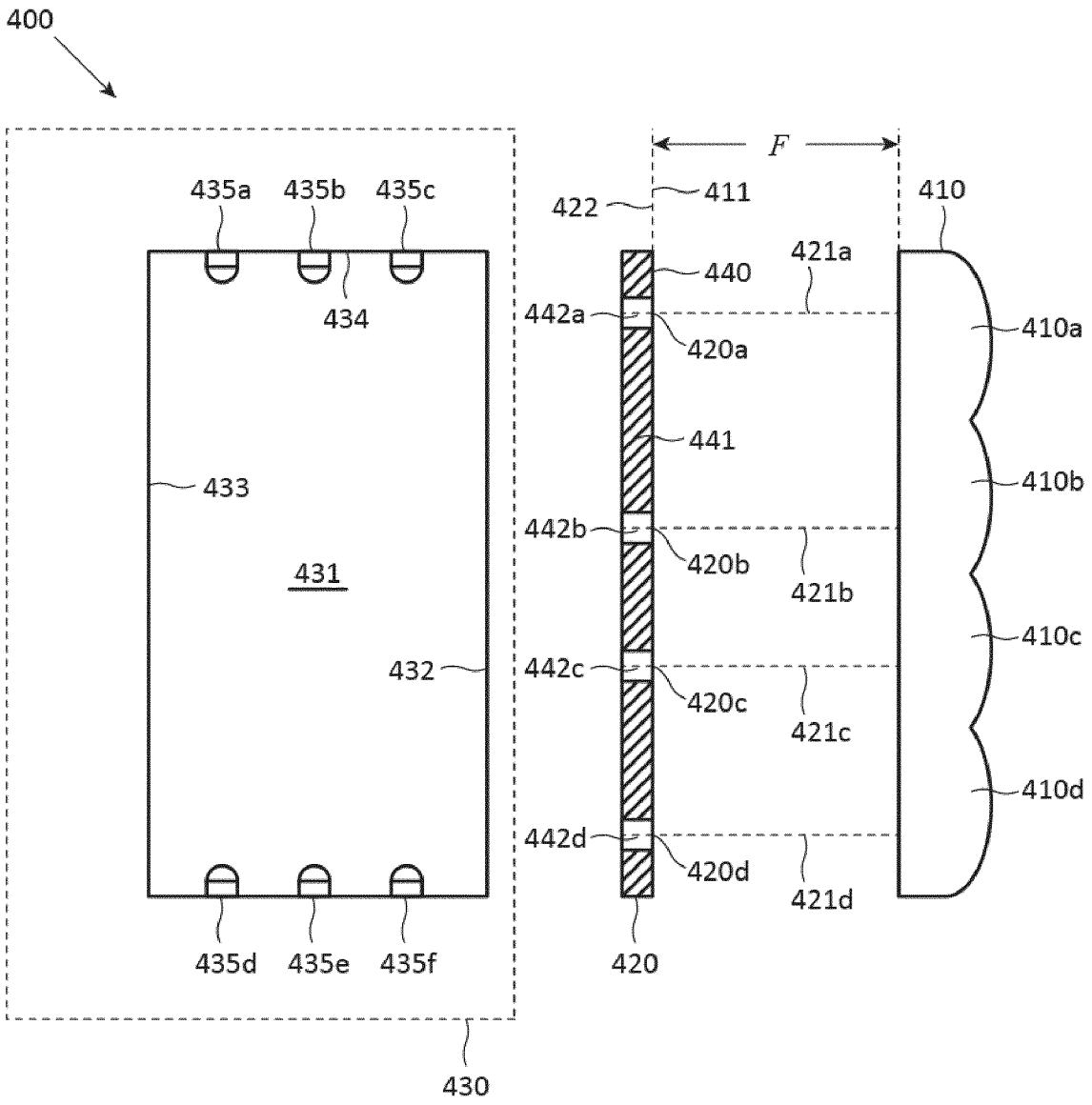
FIG. 7 shows a cross sectional view of a lighting device.

FIG. 7 shows an alternative layout of the lighting device 400, wherein the plurality of light-emitting elements 435*a-f* is provided on the side surface 434 of the light mixing chamber 431. The light-emitting elements 435*a-e* are now arranged to indirectly emit light towards the light exit window 432, viz. via reflection on the internal surface arrangement of the light mixing chamber 431.

Figure 8:
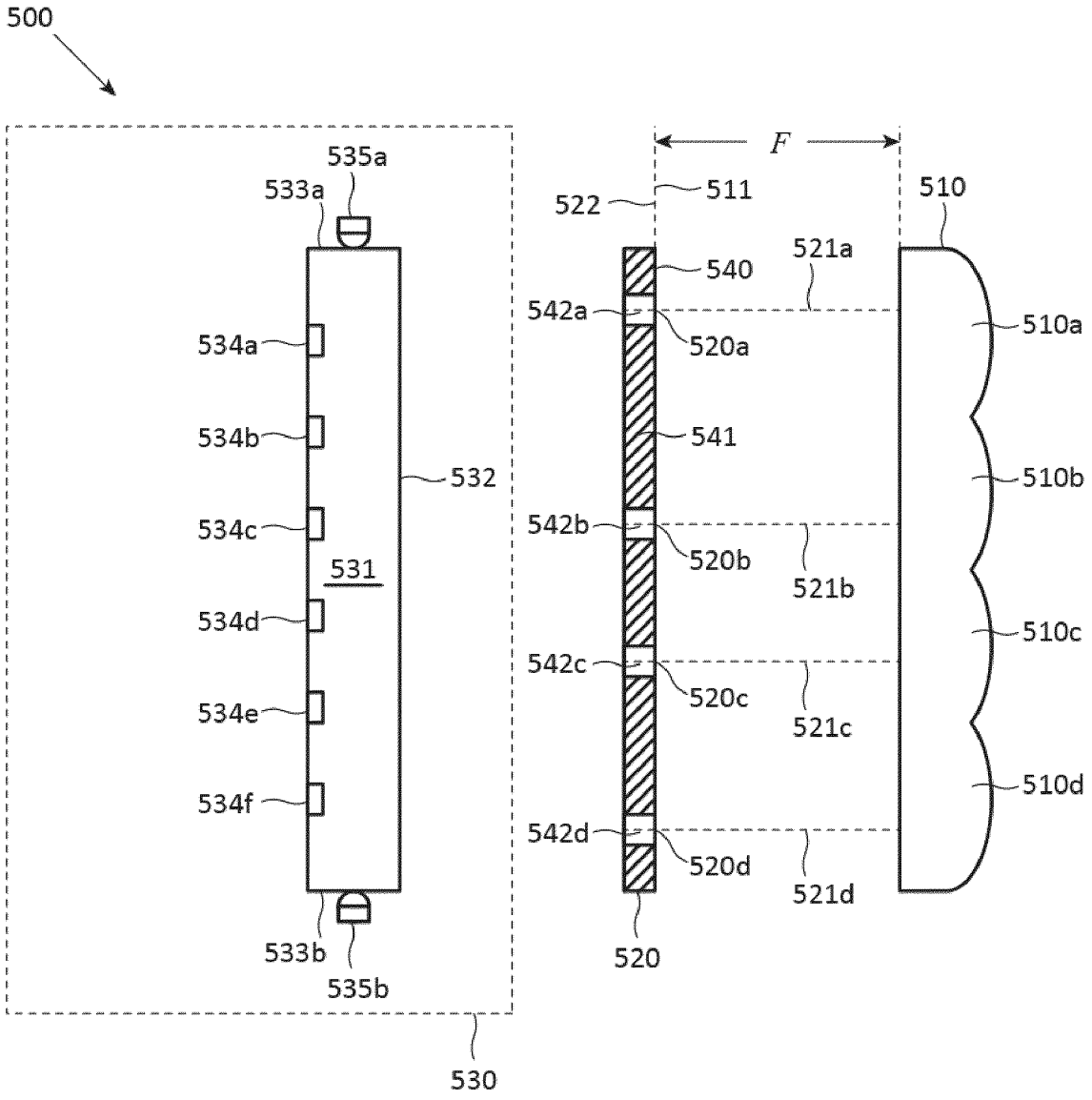
FIG. 8 shows a cross sectional view of a lighting device.

FIG. 8 shows a cross sectional view of a lighting device 500. The lighting device 500 has a lens array 510 with a plurality of lenses 510*a-d*. The lens array 510 further has a focal surface 511, being the surface that contains the focal points of the lenses 510*a-d*.

The lighting device 500 also has a light engine 530. The light engine 530 has a light guide element 531 with a first light incoupling surface 533*a* and a second light incoupling surface 533*b* located opposite from the first light incoupling surface 533*a*. The light guide element 531 also has a light outcoupling surface 532. Light-emitting element 535*a* is arranged to emit light into the light guide element 531 via the first light incoupling surface 533*a* and light-emitting element 535*b* is arranged to emit light into the light guide element 531 via the second light incoupling surface 533*b*. Light-emitting elements 535*a* and 535*b* are light-emitting diodes, but they may alternatively be other types of light-emitting elements, such as laser diodes.

The light guide element 531 has light extraction features 534*a-f* located on a surface opposite from the light outcoupling surface 532. The light extraction features 534*a-f* are for redirecting light out of the light guide element 531 via the light outcoupling surface 532. The light outcoupling surface 532 of the light guide element 531 constitutes the light exit window of the light engine 530.

In the lighting device 500, a cover layer 540 covers the light exit window 532 of the light engine 530. The cover layer 540 is similar to the cover layer 430 as shown in FIGS. 6 and 7.

The cover layer 540 has a surface portion 541 that delimits a plurality of light exit areas 542*a-d*. The surface portion 541 is light-reflective, and each light exit area 542*a-d* is a through opening in the cover layer 540. The light exit areas 542*a-d* of the cover layer 540 constitute a light source array 520 with a plurality of light sources 520*a-d*. The light sources 520*a-d* are arranged to emit light towards the lens array 510 with a light output distributed around a primary axis 521*a-d*. The light sources 520*a-d* together define a light-emitting surface 522 of the light source array 520.

Figure 9:
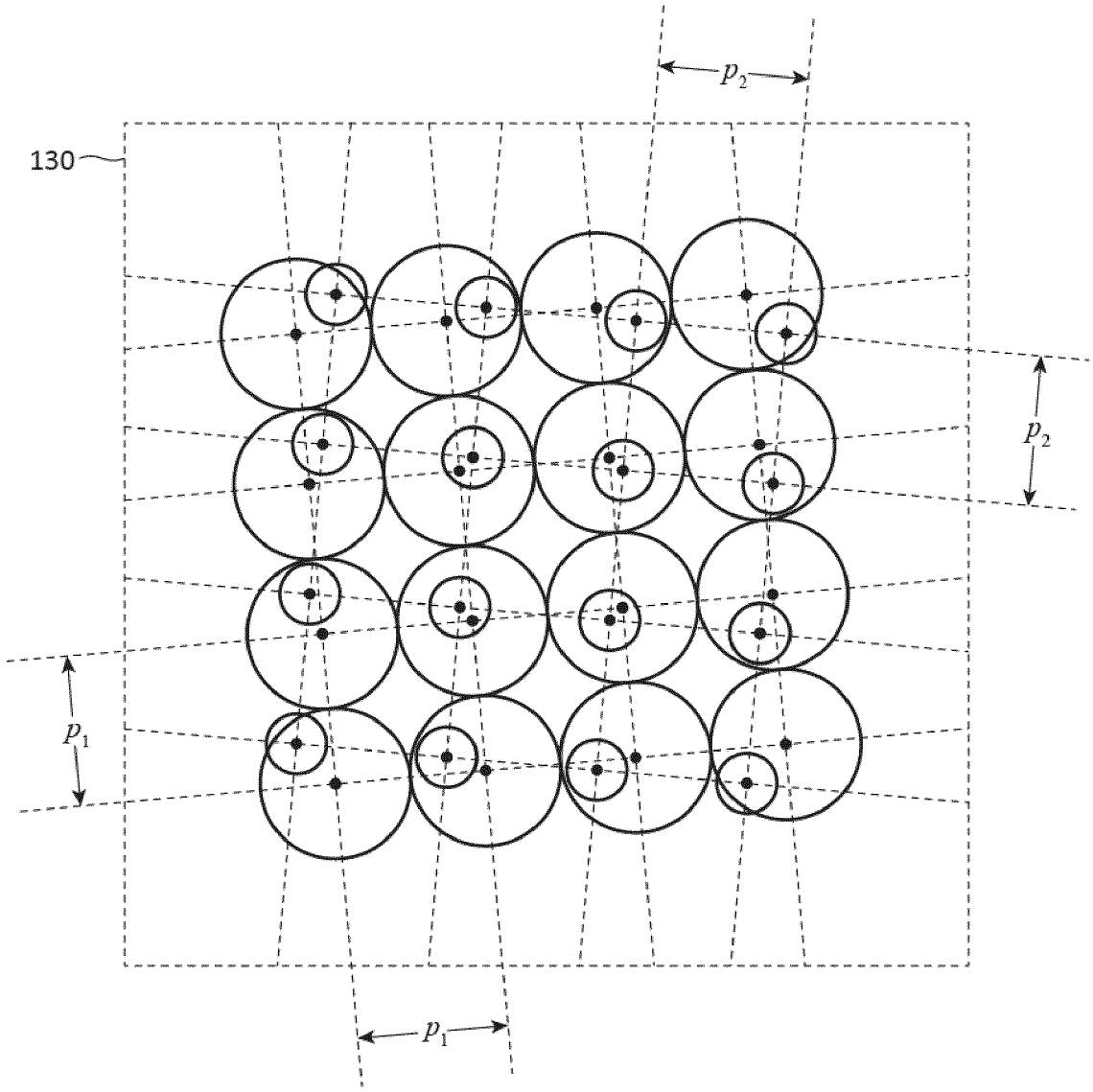
FIG. 9 shows a lighting device when viewed in a direction from the lens array towards the light source array.

FIG. 9 shows a lighting device when viewed in a direction from the lens array towards the light source array, similar to FIG. 2.

FIG. 9 shows a projection plane 130. Projections of the lenses (larger circles) and of the light sources (smaller circles) are shown in the projection plane 130. The projected centers of the lenses and the light sources are shown as black dots.

The lighting device shown in FIG. 9 has sixteen lenses that are distributed on a square lens grid with a lens pitch $p_1$. The lighting device also has sixteen light sources that are distributed in a square light source grid with a light source pitch $p_2$. The lens pitch $p_1$ is equal to the light source pitch $p_2$. Alternatively, the lens pitch $p_1$ may be different from the light source pitch $p_2$. The square lens grid and the square light source grid are mutually rotated with respect to each other.

Figure 10:
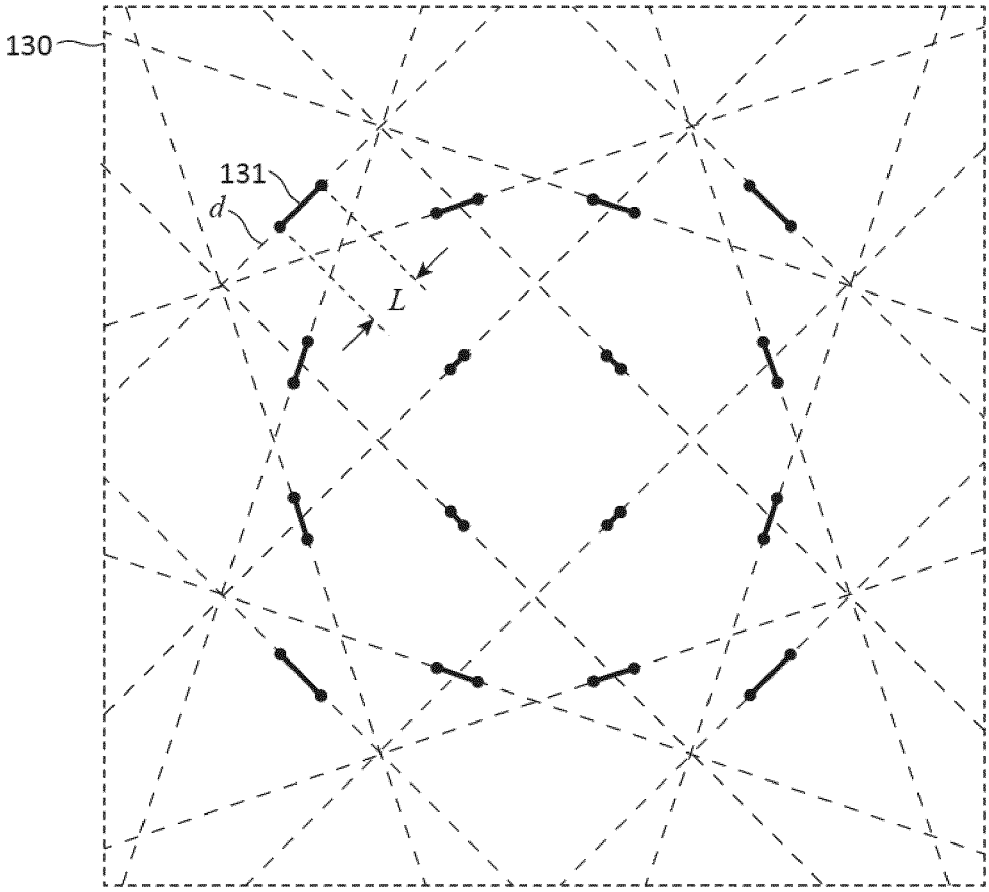
FIG. 10 shows a lighting device when viewed in a direction from the lens array towards the light source array.

FIG. 10 shows the projection plane 130 of FIG. 9, wherein for the sake of clarity, the projections of the light sources and lenses have been omitted, and only the projected centers of the light sources and the lenses are still shown. In the projection plane 130, each combination of a light source and its associated closest lens has a displacement distance 131, being the distance between the projected centers of the light source and of its associated closest lens.

Each displacement distance 131 is characterized by a displacement length L and a displacement direction d. The displacement direction d represents the orientation of the displacement distance 131 in the projection plane 130, which in FIG. 10 is indicated with a dashed straight line.

All displacement distances 131 together represent a plurality of displacement lengths L and a plurality of displacement directions d. Within all combinations of a light source and an associated closest lens there are at least two different displacement lengths L and at least two different displacement directions d.

Figure 11:
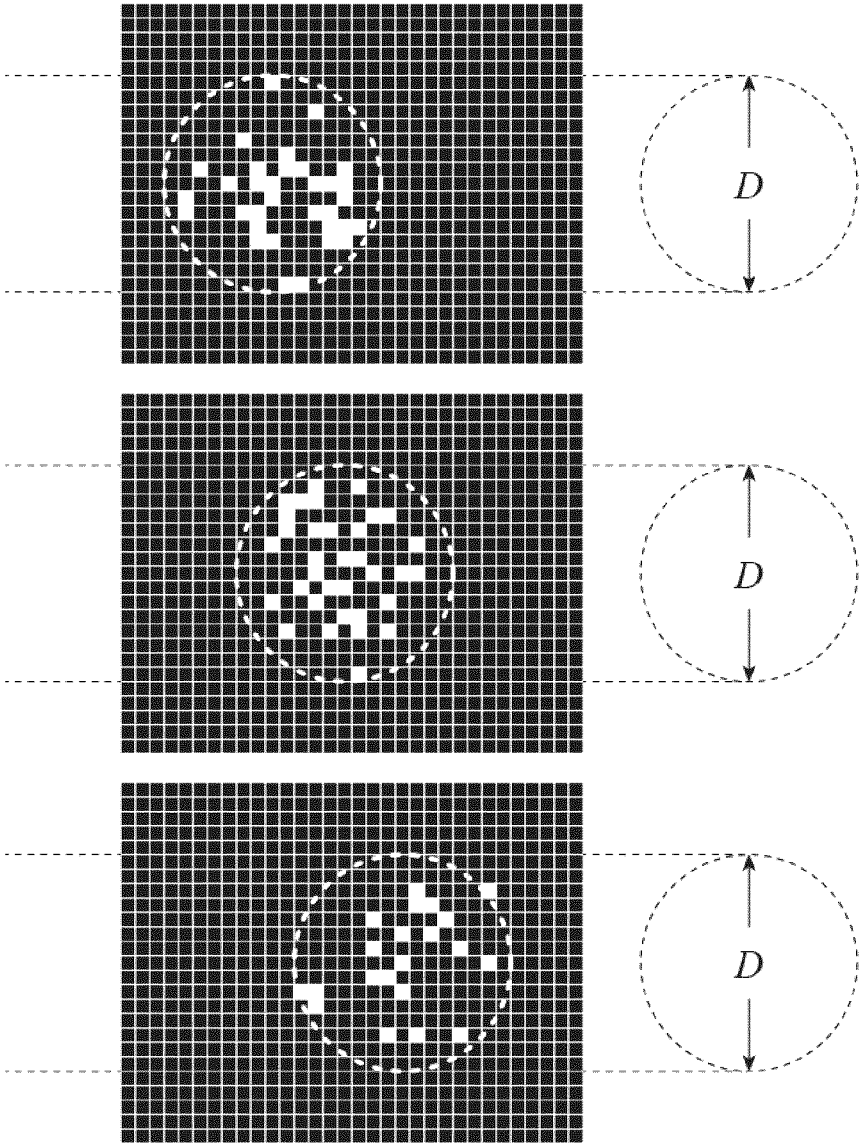
FIG. 11 shows three different light distributions as seen by an observer who moves from left to right in front of a lighting device.

FIG. 11 shows three different light distributions as seen by an observer who moves from left to right in front of a lighting device according to the invention.

Each light source of the light source array has a closest lens of the lens array. The lens array has 800 lenses arranged on a square grid with a lens pitch of 3.0 millimeters (±0.5 millimeters) in a matrix of 25 rows and 32 columns. The lens array further has a focal distance F of 12 millimeters.

Each combination of a light source and its associated closest lens is arranged to create a light output component of the lighting device. The light emitted by a light source may also be incident on, and pass through, a lens that is not the closest lens of the light source, such as a neighboring or a next-neighboring lens. This so-called cross talk will also give light output components.

All light output components together constitute the light output of the lighting device. Depending on the viewing position of the observer, only a part of the light output of the lighting device will be visible as a lighting pattern.

For each viewing position shown in FIG. 11, the visible lighting pattern is indicated by white squares surrounded by black squares, representing the visible and non-visible light output components in that viewing position, respectively.

When the observer moves from left to right in front of the lighting device, a (random) sparkling light effect can be observed.

For each viewing position shown in FIG. 11, the light output components that together constitute the lighting pattern are distributed in a circular area of diameter D. The circular area of diameter D represents the region wherein sparkling occurs, and this region moves along with the observer.

The diameter D of the region wherein sparkling occurs is dependent on the viewing distance V between the lighting device and the observer, on the maximum displacement length $L_{max}$, and on the focal distance F of the lens array, according to:

$$D = 2 \cdot V \cdot \frac{L_{max}}{F}$$

For the lighting device of FIG. 11, the maximum displacement length $L_{max}$ is 0.5 millimeters and the focal distance F is 12 millimeters. When the observer is at a distance V of 2 meters from the lighting device, the diameter D of the region where sparkling occurs is approximately 17 centimeters. If instead the maximum displacement length $L_{max}$ is increased to 2.0 millimeters, the diameter D of the region where sparkling occurs is increased to approximately 67 centimeters, which would substantially cover the full area of a lighting panel of 60 centimeters by 60 centimeters.

Next to a lighting device in the form of a panel of 60 centimeters by 60 centimeters, the invention can also be applied in a smaller lighting device, such as a lighting device of 10 centimeters by 10 centimeters, or even smaller. The sparkling light effect, which is difficult to copy, can then serve as a copy-protection measure or anti-counterfeiting measure.

In the lighting devices described above, the lens array and the light source array are stationary and in a fixed relationship relative to each other. Alternatively, the lens array and the light source array may be capable of moving relative to each other to provide a dynamic sparkling light effect, even for a stationary observer.

It should be noted that the above-mentioned lighting devices illustrate rather than limit the invention, and that those skilled in the art will be able to design many alternative lighting devices according to the invention without departing from the scope of the appended claims.

In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements.

The mere fact that certain features are recited in mutually different dependent claims does not indicate that a combination of these features cannot be used to advantage. The various aspects discussed above can be combined in order to provide additional advantages. Further, the person skilled in the art will understand that features of two or more different dependent claims may be combined.

The invention claimed is:

1. A lighting device comprising:

a lens array having a plurality of lenses and a focal surface located at a focal distance from the lens array, a light engine with one or more light-emitting elements and a light exit window, and a cover layer covering the light exit window, wherein the cover layer has a surface portion that delimits a plurality of light exit areas, each light exit area having a higher transmittance than the surface portion, wherein the light exit areas constitute a light source array having a plurality of light sources, each light source being arranged to emit light towards the lens array with a light output distributed around a primary axis, the light sources together defining a light-emitting surface of the light source array, wherein the light-emitting surface of the light source array substantially coincides with the focal surface of the lens array, wherein, in a projection plane perpendicular to the primary axis, each light source forms a combination with a closest lens, each combination having a displacement distance, being the distance between the projected centers of the light source and of its associated closest lens, with a displacement length (L) and a displacement direction (d) so that the lighting device has a plurality of displacement lengths (L) and a plurality of displacement directions (d), and wherein the plurality of displacement lengths (L) comprises at least two different displacement lengths (L), and the plurality of displacement directions (d) comprises at least two different displacement directions (d), and wherein the surface portion of the cover layer is light-transmissive, and wherein the light exit areas are through openings.

2. The lighting device according to claim 1, wherein the plurality of displacement lengths (L) is distributed over a displacement length range having an upper displacement length limit ($L_{max}$), the ratio of the upper displacement length limit ($L_{max}$) and the focal distance (F) being at least 0.18.

3. The lighting device according to claim 1, wherein the surface portion of the cover layer is at least one of diffusely light-transmissive or colored.

4. The lighting device according to claim 1, wherein the light engine has a light mixing chamber with an internal surface arrangement, the internal surface arrangement having a back surface opposite to the light exit window and a side surface separating the back surface and the light exit window, wherein the one or more light-emitting elements are provided on at least one of the back surface and the side surface, and wherein the one or more light-emitting elements are arranged to emit light towards the light exit window, either directly or via reflection on the internal surface arrangement.

5. The lighting device according to claim 1, wherein the light engine has a light guide element with a light incoupling surface and a light outcoupling surface, wherein the one or more light-emitting elements are arranged to emit light into the light guide element via the light incoupling surface, wherein the light guide element comprises light extraction features to redirect light out of the light guide element via the light outcoupling surface, and wherein the light outcoupling surface of the light guide element constitutes the light exit window of the light engine.

6. The lighting device according to claim 1, wherein the focal surface of the lens array and the light-emitting surface of the light source array are planar surfaces oriented parallel to each other.

7. The lighting device according to claim 1, wherein the plurality of lenses is distributed on an irregular lens grid, and wherein the plurality of light sources is distributed on a regular light source grid.

8. The lighting device according to claim 1, wherein the plurality of lenses is distributed on an irregular lens grid, and wherein the plurality of light sources is distributed on an irregular light source grid.

9. The lighting device according to claim 1, wherein the plurality of lenses is distributed on a regular lens grid with a shortest lens pitch ($p_1$), and wherein each displacement length (L) is equal to or smaller than half the shortest lens pitch ($p_1$).

10. The lighting device according to claim 9, wherein the regular lens grid is one of a rectangular grid, a square grid or a hexagonal grid.

11. The lighting device according to claim 9, wherein the plurality of light sources is distributed on an irregular light source grid.

12. The lighting device according to claim 9, wherein the plurality of light sources is distributed on a regular light source grid, and wherein the regular lens grid and the regular light source grid are mutually rotated with respect to each other.

* * * * *